United States Patent [19]

Feher

[11] Patent Number: 4,923,248

[45] Date of Patent: May 8, 1990

[54] COOLING AND HEATING SEAT PAD CONSTRUCTION

[76] Inventor: Steve Feher, 1909 Aleo Pl., Honolulu, Hi. 96822

[21] Appl. No.: 272,518

[22] Filed: Nov. 17, 1988

[51] Int. Cl.[5] ..... A47C 7/74

[52] U.S. Cl. ..... 297/180; 297/453; 5/469

[58] Field of Search ..... 297/180, 453; 5/453, 5/469

[56] References Cited

U.S. PATENT DOCUMENTS

| | | | |
|---|---|---|---|
| 1,541,213 | 6/1925 | Harley | 297/453 X |
| 2,782,834 | 2/1957 | Vigo | 297/180 |
| 2,912,832 | 11/1959 | Clark | 297/180 X |
| 2,992,604 | 7/1961 | Trotman et al. | 297/180 X |
| 3,030,145 | 4/1962 | Kottemann | 297/180 |
| 3,136,577 | 6/1964 | Richard | 297/180 |
| 3,137,523 | 6/1964 | Karner | 297/180 |
| 3,162,489 | 12/1964 | Trotman | 297/453 |
| 4,712,832 | 12/1987 | Antolini et al. | 297/180 |

FOREIGN PATENT DOCUMENTS

| | | | |
|---|---|---|---|
| 1244292 | 9/1960 | France | 297/180 |
| 271598 | 11/1950 | Switzerland | 297/180 |
| 923417 | 4/1963 | United Kingdom | 297/453 |

*Primary Examiner*—Peter R. Brown
*Attorney, Agent, or Firm*—George J. Netter

[57] ABSTRACT

A seat pad and backrest enclose a plenum into which pressurized air is provided from a closely adjacent Peltier air temperature and humidity modifying apparatus (either cooled or warmed). A metallic mesh is part of the seat pad and backrest and warms or cools the user by conduction. Alternatively, the seat pad and backrest can be separate each having its own plenum, and modified air is provided to both via a selectively adjustable proportioning valve. Yet another alternative unitarily incorporates a seat pad and backrest into a chair with a single plenum fed temperature modified air from a Peltier unit mounted on the chair.

12 Claims, 8 Drawing Sheets

COOLING AND HEATING SEAT PAD CONSTRUCTION

The present invention relates generally to a seat pad construction, and, more particularly, to a seat pad construction which can be selectively cooled or heated.

BACKGROUND

In the usual situation temperature modified air is provided to relatively extensive areas such as entire buildings, selected offices or suites of rooms within a building, or, in the case of automotive vehicles, the entire vehicle is cooled or heated as a unit.

There are many situations, however, in which more restricted air temperature modification, the ultimate use of which is to enhance the comfort of human beings, is desirable. For example, it may be desirable to provide a chair or seat, the immediate surroundings of which can be selectively cooled or heated, and yet the modified effect cannot be noted to any substantial extent beyond that range.

SUMMARY OF THE INVENTION

In accordance with the practice of the present invention there is provided a seat pad construction with air temperature modification apparatus for selectively providing heated or cooled air to the seat pad interior. The pad has back rest and seat portions including a plurality of coil spring elements arranged such that the weight of the user is exerted transversely against the planes of the spring coils. Several layers of air permeable material enclose the coil springs on the major surface facing an individual using the pad, and an air impermeable material is applied to the opposite major surface and sides. In addition, air flow barrier layers are located toward the front of the seat between the legs of a user and on the outer surface between the backrest and seat.

In this manner a plenum is formed between the back and the front surface of both the back rest as well as the seat portion into which air having its temperature modified by apparatus located conveniently adjacent is conduited via a fitting at the seat front.

It is contemplated that the seat pad construction could be placed on an automobile seat, a specialty chair such as a dentist's chair or other examination type chairs, or onto the usual overstuffed chair found in many homes. The energy requirements are modest since the area to be cooled or heated is relatively small, and the localized effect does not disturb others in the vehicle or room. This latter feature may be especially advantageous where a patient may have to be in a dentist's chair for an extended period of time and cooling/heating may increase the patient's comfort; however, the dentist or technicians working on the patient may not wish to be exposed to additional cooling or heating.

This invention is believed to be most advantageously employed in providing substantially instantaneous heating or cooling to the driver of an automotive vehicle In summer weather, it is a common experience on returning to a car which has been parked in an unshaded area for a long period of time to find the vehicle very hot and the seat feeling very uncomfortable for some time even with normal air conditioning. Also, in the wintertime, it may be highly desirable to have means such as the present invention for quickly warming the body until the vehicle heater is able to warm the vehicle interior.

The air modifying apparatus consists of a housing enclosing Peltier effect devices which can be selectively energized to heat or cool air passing thereover. There are two chambers, a first for providing air from the surrounding environment in contact with one surface of the Peltier effect devices where the temperature is modified and then further driving the air over a condensate trap to remove excess moisture before ultimate delivery to the seat pad. A second chamber in physical contact with another surface of the Peltier effect devices where air driven therepast by a tangential blower is heated in the cooling mode and it is this air which is directed back to the environment. Electricity for the apparatus can be obtained in the case of an automobile via cabling plugged into the cigarette lighter socket, for example, or directly from the vehicle electrical supply.

DESCRIPTION OF A PREFERRED EMBODIMENT

Figure 1:
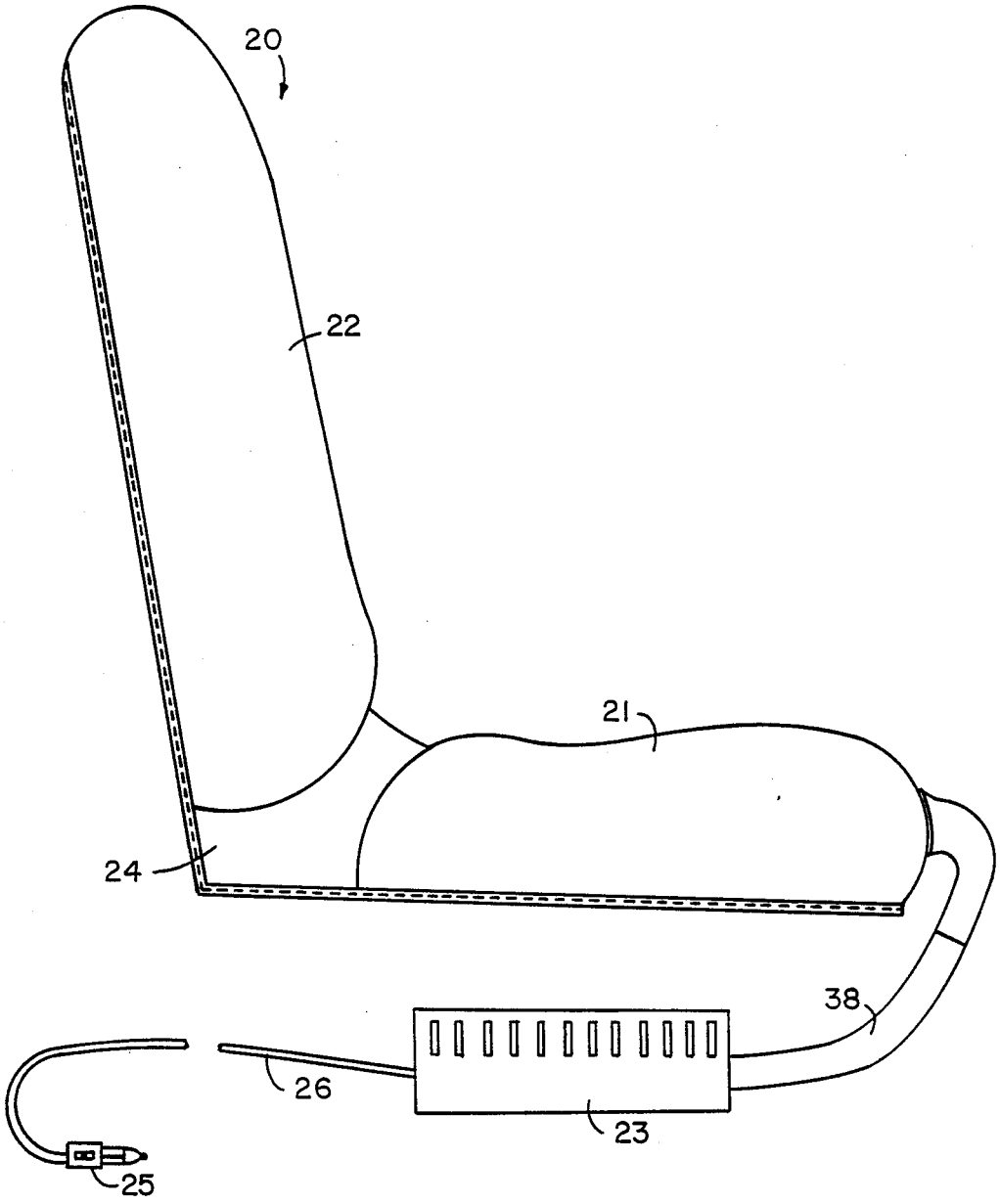
FIG. 1 is a side elevational view of a seat pad construction of the invention shown installed for use in an automotive vehicle seat.
Figure 2:
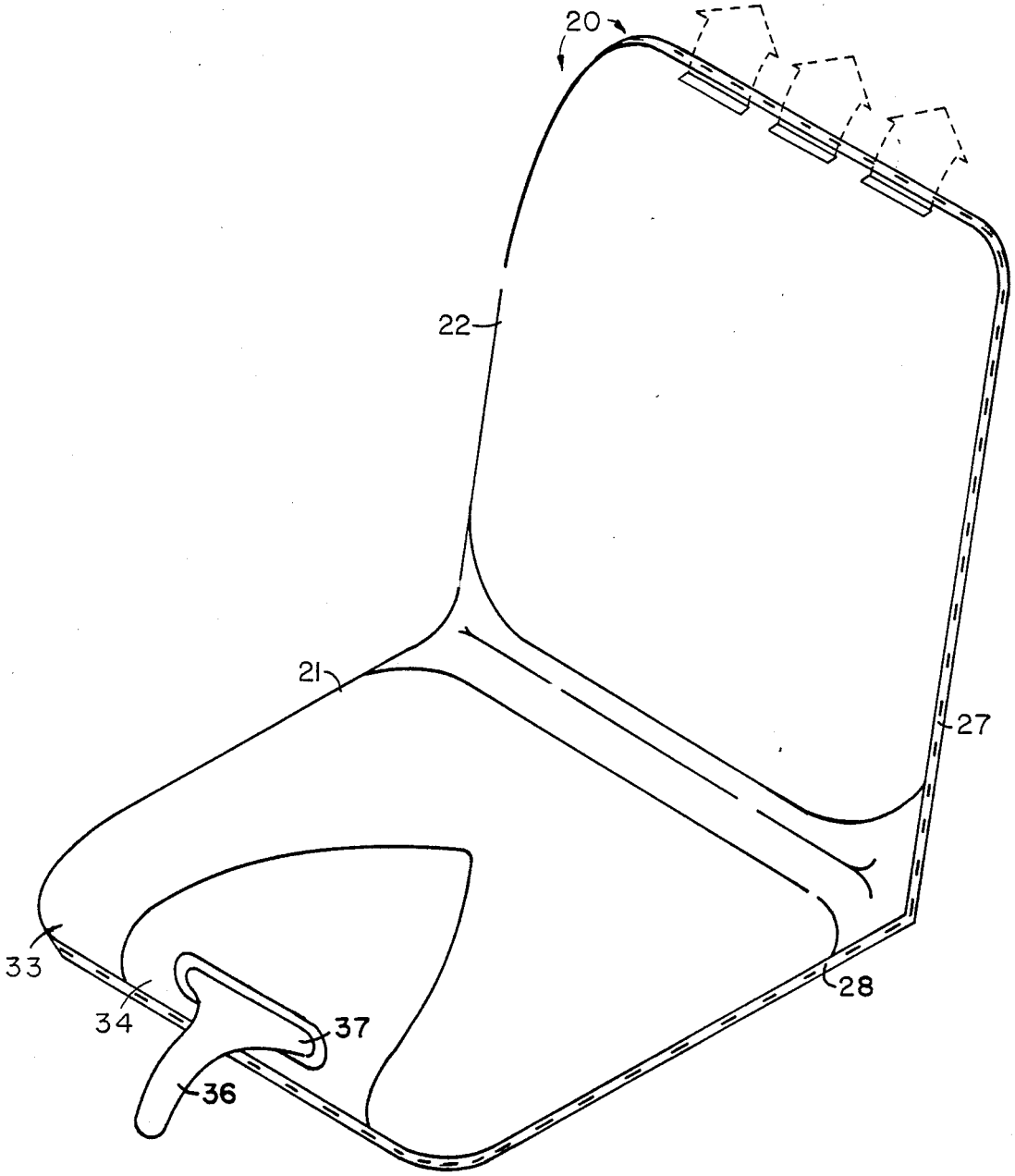
FIG. 2 is a perspective view of the seat pad construction of this invention shown disconnected from the air temperature modifying apparatus.

Turning now to FIGS. 1 and 2 of the drawing, the seat pad construction of the present invention is enumerated generally as 20 and generally includes an elongated pad having a seat portion 21 and unitary backrest 22. An internal plenum is provided with conditioned or temperature and humidity modified air by an externally located Peltier heating/cooling apparatus 23 which is preferably electrically powered. The seat pad construction 20 can be integrally built into a seat or chair 24 (FIG. 5) or may be separate and merely resting on the seat or chair. In an automotive vehicle, electricity can be provided by the cigarette lighter through a suitable socket 25 and cabling 26.

Figure 3:
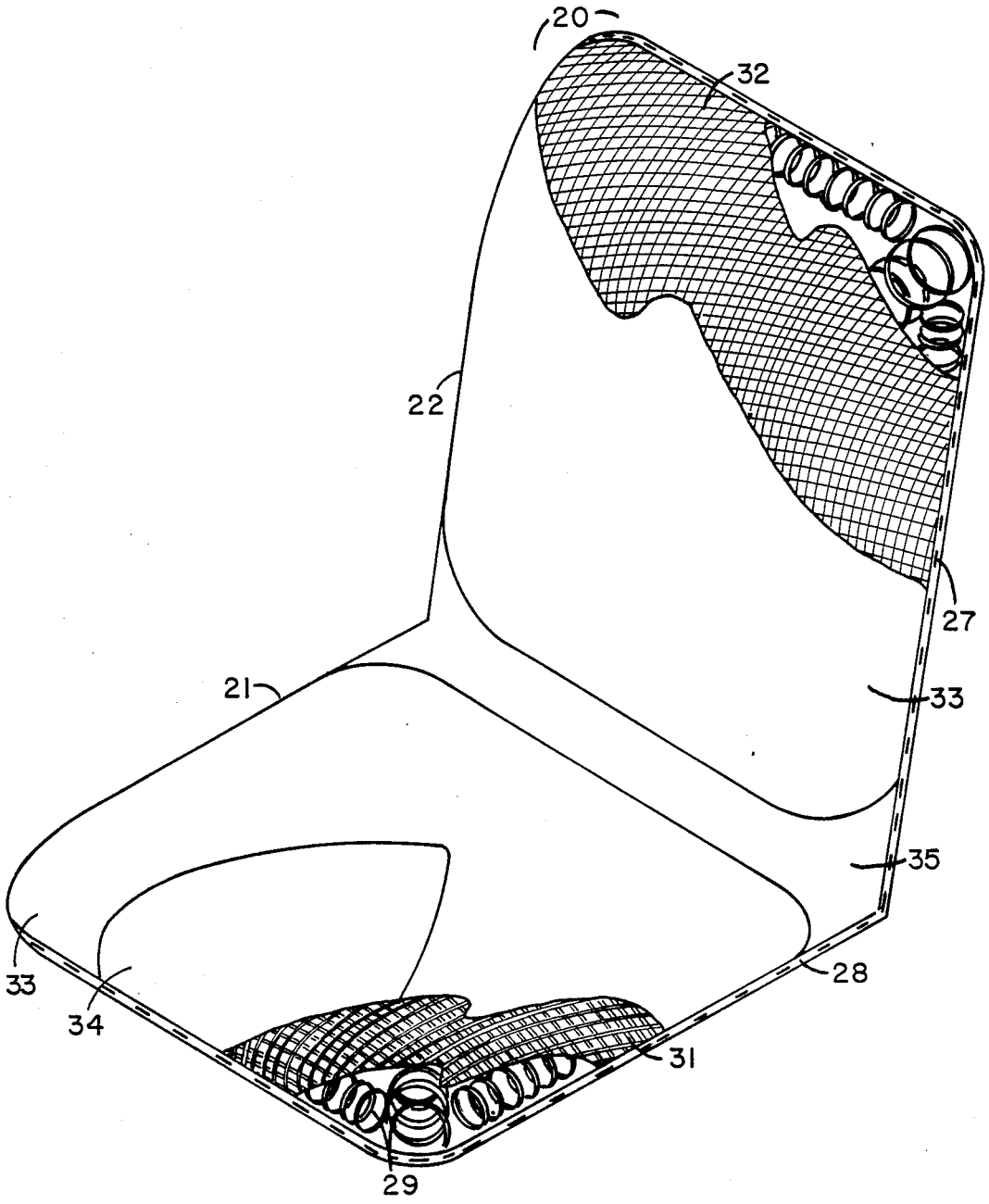
FIG. 3 is a perspective view of the seat pad of FIG. 2 with portions thereof shown in sectional and fragmentary views.
Figure 11:
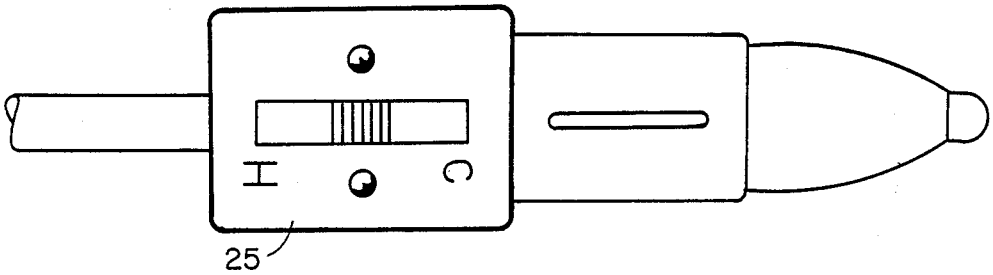
FIG. 11 is an elevational enlarged view of the electrical switch and socket for use with the air temperature modifying apparatus.
Figure 4:
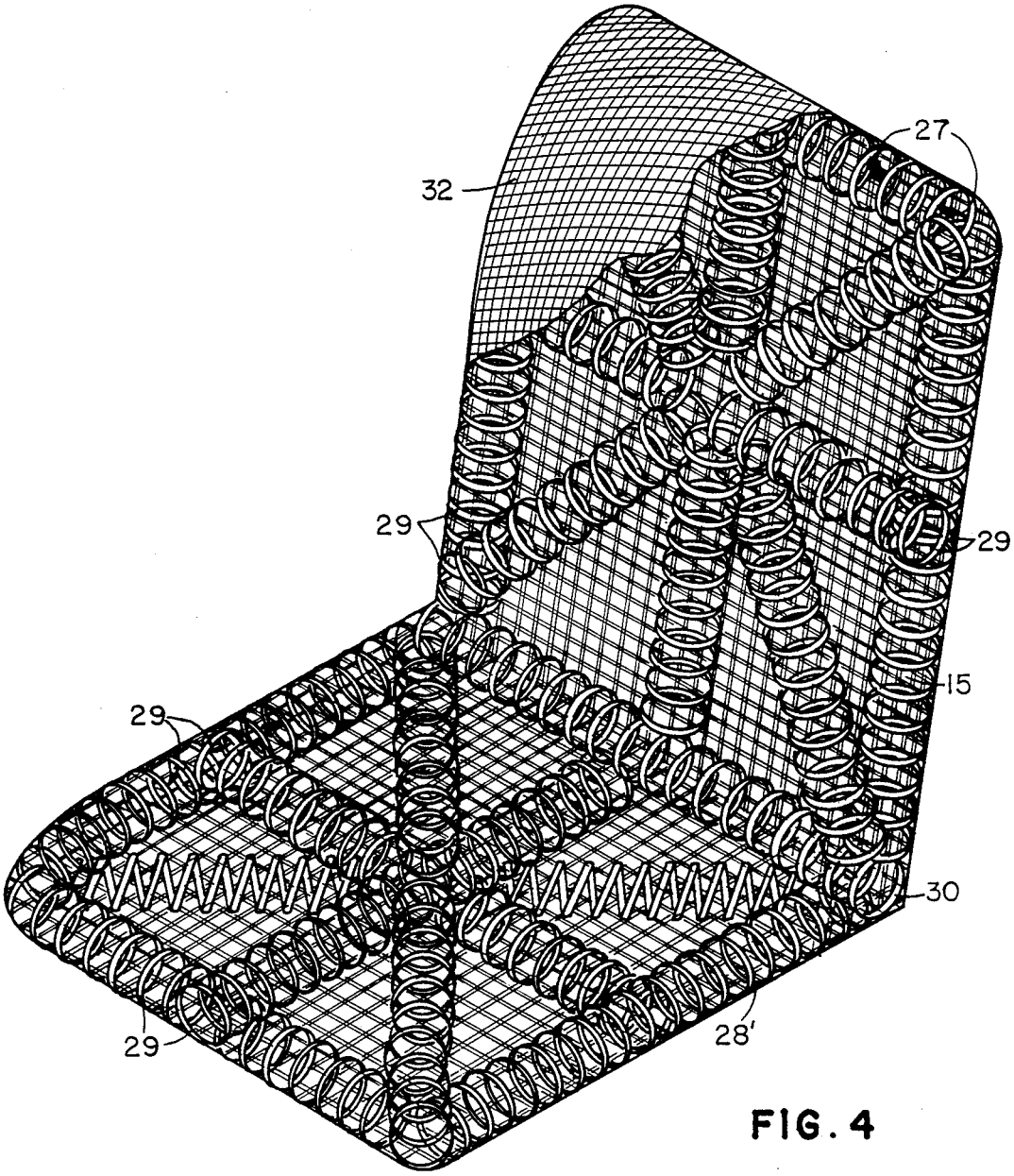
FIG. 4 is a further perspective view of the seat pad construction with substantially all outer covering removed.

For the ensuing detailed seat pad construction aspects, reference is now additionally made to FIGS. 2 through 4. As shown there, the external rear surface for both the back rest 22 and seat portion 21 includes airtight, but not exceptionally rigid, plates or sheets 27 and 28, respectively, of an air impermeable material. These plates are secured together into a generally L-shaped relation with some ability to rotate about the junction between the backrest and seat so as to conform to most seats or chairs. The inner surfaces of the plates 27 and 28 are covered with a tightly woven plastic fibers mesh 28' (FIG. 4).

Onto the mesh 28' over each of the plates 27, 28 there are a plurality of helically wound coil springs 29 arranged as spokes in a wheel with inner ends at substantially the center points, respectively, of the backrest and seat. Interconnection of the springs is accomplished by coiling the loop ends together, or alternatively by the outer ends secured by stapling, for example, or any other convenient manner to the plates 27 and 28. The spring coils, when arranged as described, receive the weight of a user of the seat construction transversely of the coil loops in both the seat and backrest portions without closing off the plenum. A further spring coil 30 is arranged along the junction of the two plates 27 and 28 and in the same manner as springs 29 prevents a closing-off of the space between the backrest and seat portion and yet allows a hinge action to take place there.

A sheet of fine plastic mesh 31 which is moderately permeable by air covers over the top surface of the coil springs in the seat portion 21 and has its edges secured to the plate 28 (FIG. 3). The plastic mesh extends up to the region dividing the seat portion from the backrest. The springs in the backrest are stretchably covered by aluminum or copper open mesh 32 which, in addition to acting as a means for spreading the applied pressure over the underlying springs, also because of its greater heat conduction properties than plastic, establishes a layer against a user's back which rapidly follows temperature changes of the air in the backrest plenum. An extent of slightly permeable woven fabric 31 is then applied over the layers 31 and 32, and affixed at the edges of the plates 27 and 28 by stapling or any other suitable means. This outer fabric can be colored or provided with any desirable designs for aesthetic purposes as long as the air permeability is not cut off.

Two areas 34 and 35 are covered with an air flow barrier material such as silkscreened latex, for example. Area 34 coincides with the space typically lying between a user's legs and area 35 is along the pad hinge region between the seat and backrest, both of which do not normally require temperature adjustment. At the uppermost edge of the backrest a plurality of vents 35' are provided via which pressurized temperature modified air passing through the seat pad exits to the environment.

Toward the front of the seat portion 21 and closely adjacent the front edge, there is provided a short length of conduit 36 (FIGS. 1 and 2) having an open outer end which is secured to the underlying mesh via an enlarged portion 37. The conduit 36 is releasably connected to the Peltier apparatus 23 by hosing 38 via which temperature modified air is pumped to the interior of the seat construction.

Figure 9:
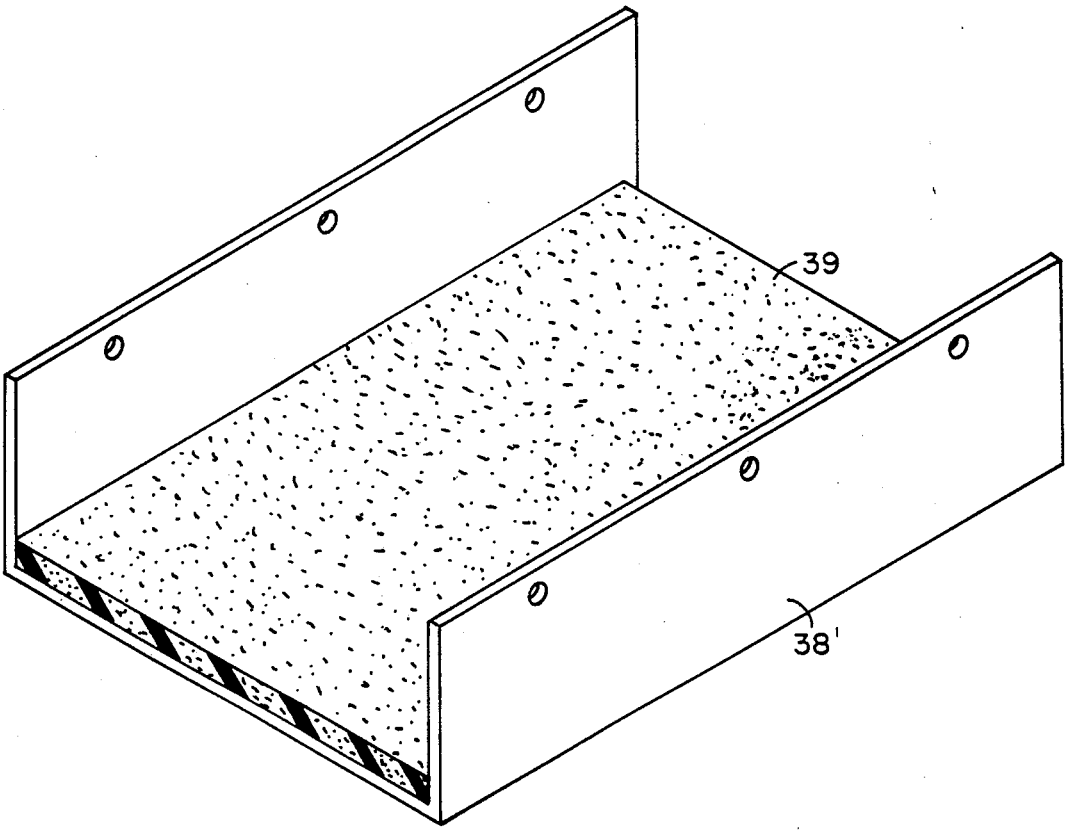
FIG. 9 is a perspective view of a housing shell including a condensate trap.

Turning now to FIG. 9, the apparatus 23 for producing temperature modified air for the seat pad construction is mounted in a generally pan shaped housing 38' having a bottom, side walls and an open top, and resting on the bottom of which is a porous foam rubber or plastic member 39. In a way that will be more particularly described the member 39 absorbs moisture and in that way serves as a condensate trap.

Figure 8:
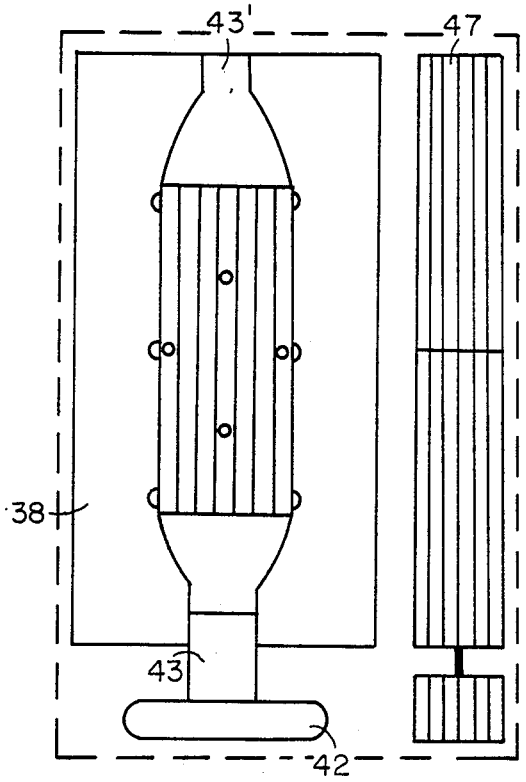
FIG. 8 is a bottom plan view of the apparatus of FIG. 6.

A metal heat exchanger 40 having a plurality of fins 41 extending from one major surface is mounted in the housing 38', the fins extending downwardly with their outer edges spaced just above the condensate trap 39. As can be seen best in FIG. 8, environmental air is passed through a filter 42 by an axial blower 43 and then over the heat exchanger fins 41 where it is conditioned. The cooled or heated air exits at openings 43' which is connected to the seat construction conduit 36 via a suitable length of hosing 38.

Figure 6:
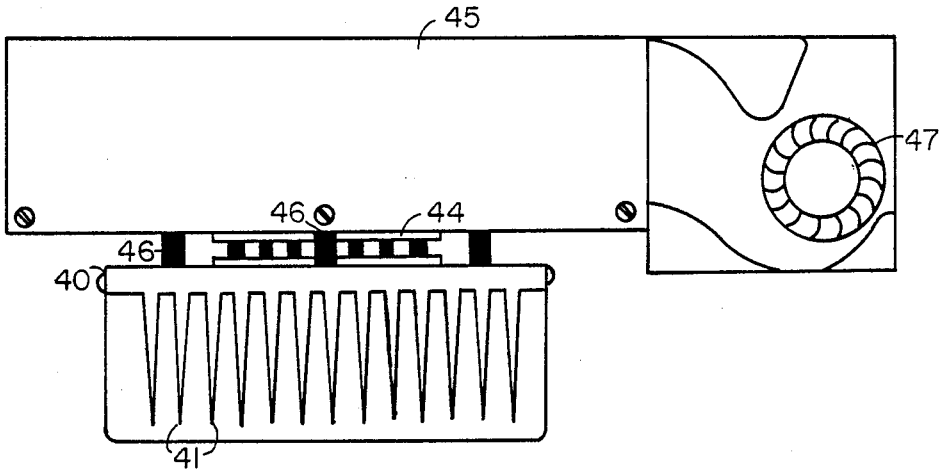
FIG. 6 is a side elevational view of the air modifying apparatus.
Figure 7:
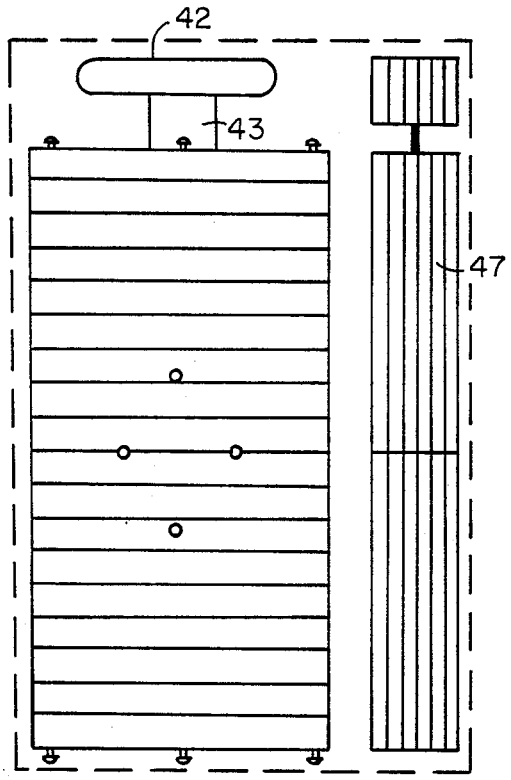
FIG. 7 is a top plan view of the apparatus of FIG. 6.
Figure 10:
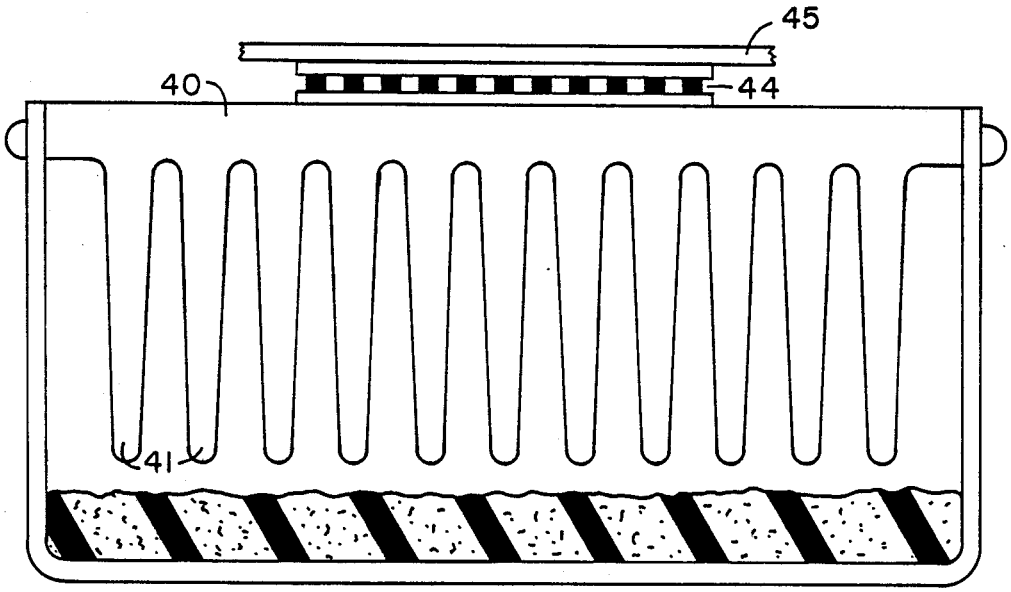
FIG. 10 is an end view of the housing of FIG. 9 shown with apparatus mounted therein.

With reference now to FIGS. 6 and 10, there is shown a plurality of Peltier stacks enumerated collectively as 44, one surface of which is maintained in good contacting heat conductive relation to the outer surface of the heat exchanger 40. The other surface of the Peltier plates are in good heat conducting contact with an open ended chamber 45 mounted to the base plate of the heat exchanger by screws 46 as shown in FIG. 6. A tangential cross-flow blower 47 mounted conveniently adjacent one end of the chamber moves air through the chamber which serves to dissipate heat absorbed by the cold side during cooling mode, and to supply heat from ambient air to the hot side when in the heating mode. As is well known to those skilled in the art, switching polarity of energizing voltage to the Peltier stacks changes what is the cold side in cooling mode to the hot side in heating mode.

The apparatus 23 (FIG. 1) can be constructed in a relatively flat pack arrangement enabling location under an automobile front seat, for example, and thus out of the way.

Figure 12:
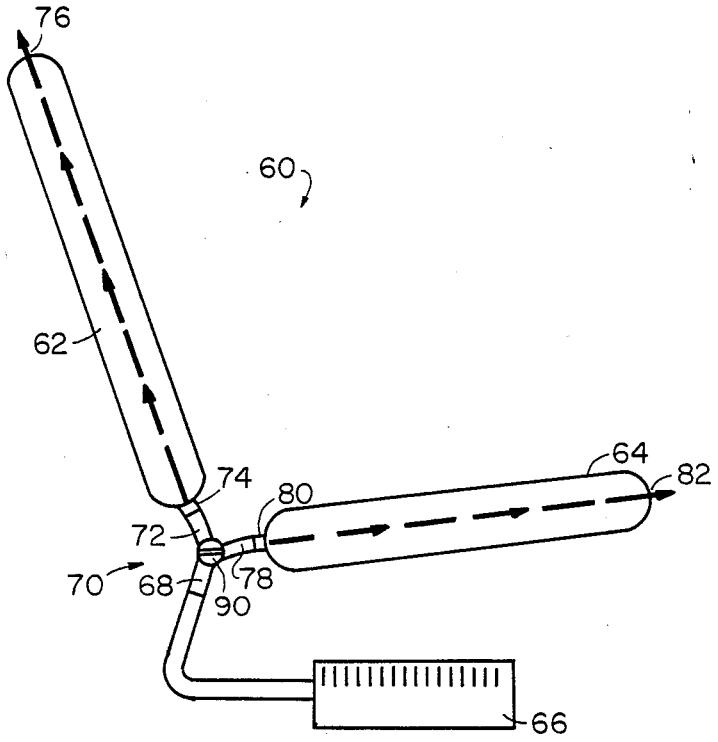
FIG. 12 is a side elevational view of yet another embodiment of the seat pad construction.

In use of the seat pad construction described in an automotive vehicle environment, the electrical jack 25 can be plugged into the dashboard cigarette lighter (not shown) or, alternatively, it may be directly interconnected to the automobile electrical system. With the power switch set to either cooling (C) or heating (H) as shown in FIG. 12, the axial blower 43 and horizontal blower 47 begin to operate which sets a reference temperature in the chamber 45 against which the Peltier plates then begin to cool or warm, depending upon the electrical setting of the energization equipment. The temperature modified air then passes outwardly along hose 38 from the apparatus 23 through the conduit 36 and into the plenum formed in the seat and backrest providing a seat and backrest portion which, depending upon the situation, either cools or warms an individual using the seat pad.

In a practical construction of the present invention, the mesh 31 for the seat portion was a $50 \times 50$ mesh using 0.020 inch diameter plastic fibers. For the backrest layer 32 a $40 \times 40$ mesh constructed of 0.010 inch diameter copper wire was used. The purpose of the metal mesh in the backrest is to compensate for the loss in $\Delta t$ between the seat and the backrest (i.e., air heat absorption in the seat). That is, thermal exchange efficiency must be better in the backrest than in the seat. A Peltier thermoelectric module, CP-1.4-127-045L manufactured by Melcor, Inc., Trenton, New Jersey, provided the desired air temperature modification with an axial blower delivering 4–6 cubic feet per minute.

Figure 5:
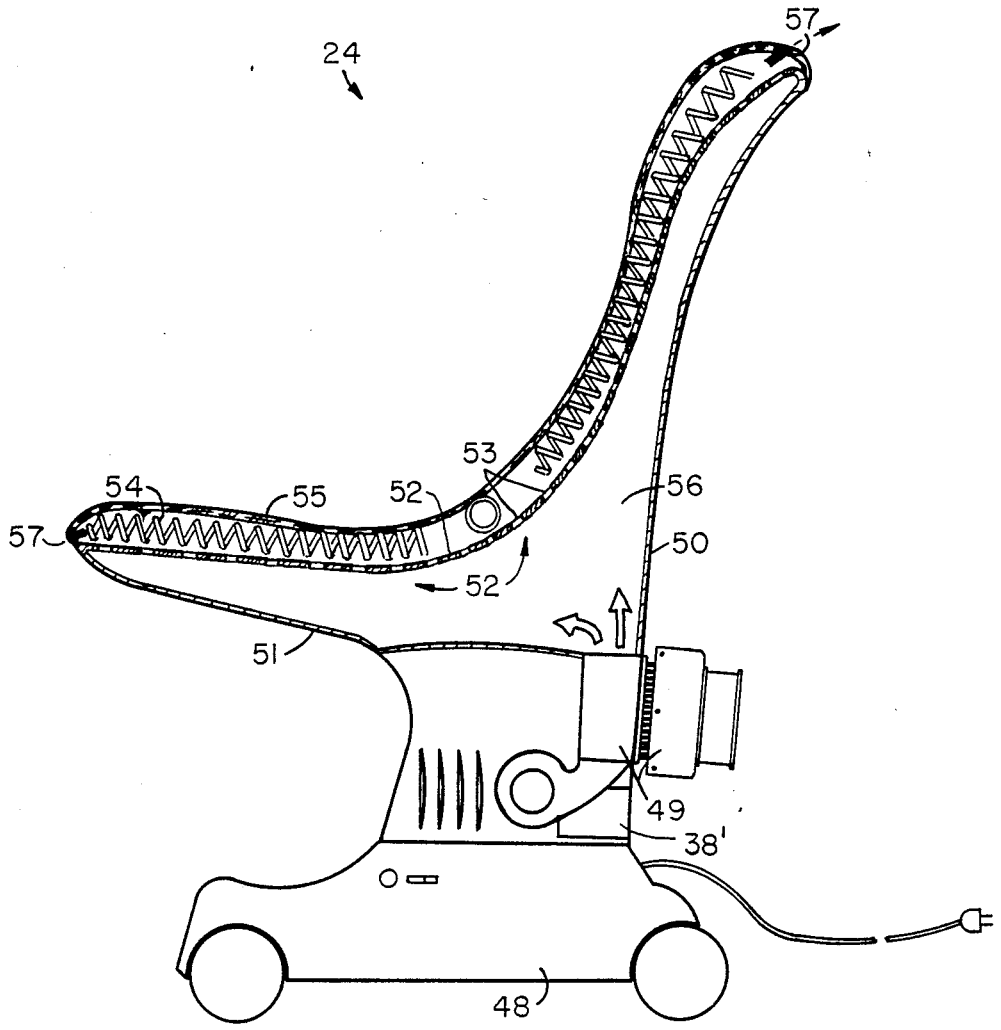
FIG. 5 shows the seat pad construction adapted for use in a dental chair or treatment chair.

Although the invention is described particularly in connection with use in an automotive vehicle, it can also be advantageously employed with office chairs, or patient examination chairs as shown in FIG. 5, for example. Such a chair 24 would typically include a wheeled base 48, although it could be fixedly secured to any suitable ground plane. The air modifying apparatus 49 is mounted onto the base 48 and can be identical to the apparatus 23 described in connection with the first embodiment. The chair further includes air impermeable back and bottom plates 50 and 51. A one-piece, generally L-shaped seating support surface 52 is constructed of a relatively rigid plate having a large number of openings 53 distributed over its surface. A set of coil springs 54 identical to springs 29 and 30 of the first described embodiment are enclosed with mesh fabric layers as in the first version. In use, pressurized temperature and dehumidified air from apparatus 49 is passed into the plenum 56 defined by 50, 51 and 52 and then through openings 53 to the seat pad proper for providing a cooled or heated surface, as the case may be, to the user. Vents 57 serve to exit air from the interior.

A still further embodiment of the present invention depicted in FIG. 12 pertains to a seat construction enumerated generally as 60 having separate backrest and seat pads 62 and 64, respectively, which are selectively adjustable to cool or warm the user, as desired. The pads 62 and 64 can be constructed identically to the embodiment of FIGS. 3 and 4, for example, in that each includes coil springs similar to springs 29 enclosed by mesh and fabric as described to enclose a plenum and provide an outer heat transferring surface for contacting the user. Temperature modified air obtained from apparatus 66, which can be identical to apparatus 23, is provided to an entrance end 68 of a Y-fitting 70. A first fitting exit 72 communicates temperature modified air through a flexible hose 74 and through the lower edge wall of the backrest pad 62 into the interior plenum, which air leaves the backrest pad through one or more vents 76 located on the upper edge of 62.

A second fitting exit 78 interconnects with the back edge of the seat pad 64 through a flexible hose 80, the temperature modified air leaving the seat pad plenum via one or more vents 82 at the front or leading edge of the seat pad.

Figure 13:
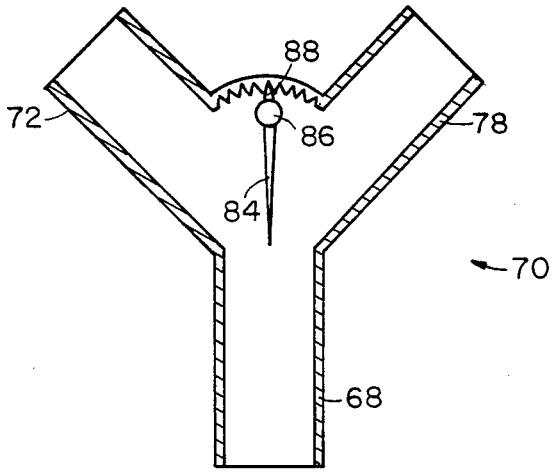
FIG. 13 is an elevational sectional view of a valving means for use in the FIG. 12 embodiment.

As shown in the Y-fitting sectional view of FIG. 13, a flap valve 84 rotatably mounted on shaft 86 can be adjusted from a first extreme where the exit fitting 72 is closed from all temperature modified air from apparatus 66 to a second extreme where exit fitting 78 is closed off from passing air to the seat pad. In between the two extreme adjustments, temperature modified air is proportioned to the seat and backrest pads depending upon the valve setting. A detent pin 88 on the flap valve moves along and in contact with detent teeth in the inner surface of the Y-fitting wall between exits 72 and 78 to provide a positive adjustment setting for the valve. A control knob 90 enables manual adjustment of the valve to achieve the desired proportion of cooling/warming between the seat and backrest pads desired.

What is claimed is:

1. A seat pad construction for receiving temperature conditioned pressurized air and have its temperature modified accordingly, comprising:

first and second air-tight plate means hingedly interconnected along an edge in a generally L-shaped configuration defining the seat and backrest, respectively;

first spring means overlying the facing major surfaces of the first and second plate means;

second spring means extending along the interconnection of the first and second plate means;

a first air permeable material consisting of plastic mesh overlying the first spring means applied over the first plate means and secured to the first plate means edges;

a second air permeable material consisting of a copper wire mesh overlying the first spring means applied over the second plate means and secured to the second plate means edges;

a first air flow barrier located over the second spring means and edge interconnected with both the first and second air permeable materials;

a second air flow barrier located on the first spring means in the central leading top edge portion of the first plate means secured to both an edge of the first plate means and the first air permeable material; and means mounted onto the second air flow barrier for interconnecting a source of pressurized modified air to the seat pad plenum defined by the first and second plate means covered by the first and second air permeable materials and the first and second air flow barriers.

2. A seat pad construction as in claim 1, in which the first spring means include a plurality of helical coil springs arranged with the planes of the spring loops substantially normal to the major surface planes of the first and second plate means.

3. A seat pad construction as in claim 1, in which the second spring means consists of a helically wound coil spring, the planes of the coil loops being arranged substantially normal to the interconnection edges of the first and second plate means.

4. A seat pad construction as in claim 1, in which the means for interconnecting includes an open-ended length of tubular conduit.

5. A seat pad construction as in claim 1, in which a layer of a closely woven plastic mesh is located between the first spring means and the first and second plate means.

6. A seat pad construction as in claim 1, in which the pressurized air is conditioned by Peltier heating/ cooling means.

7. Apparatus for selectively cooling or heating an automotive vehicle seat, comprising:

a seat pad having a seat and backrest portions with an enclosed plenum extending throughout the seat and backrest portions, the major surfaces of the seat pad facing outwardly in a direction toward a user including an air permeable covering having first heat condition properties in the seat portion and second heat conduction properties in the backrest portion greater than the first heat conduction properties, and the major surfaces facing away from a user being air-tight;

the air permeable covering being secured to the edges of said seat and backrest portions to define said plenum;

a selectively energizable Peltier unit for providing pressurized temperature modified air; and conduit means interconnecting the Peltier unit and the seat pad plenum.

8. Apparatus as in claim 7, in which the Peltier unit is so shaped and dimensioned as to enable locating under an automotive vehicle seat, and means are provided for energizing the Peltier unit by the vehicle electrical system.

9. Apparatus as in claim 8, in which the Peltier unit includes electric cable means with a jack at one end for receipt within a vehicle cigarette lighter socket.

10. Apparatus as in claim 7, in which the seat pad rests upon a vehicle seat, and the seat and backrest are hinged so as to conform to the vehicle seat.

11. Apparatus as in claim 7, in which the Peltier unit includes a tangential blower for moving ambient air across a heat exchanger and a spongelike condensate trap.

12. A seat pad construction for receiving temperature conditioned pressurized air and have its temperature modified accordingly, comprising:

first and second air-tight plate means hingedly interconnected along an edge in a generally L-shaped configuration defining the seat and backrest, respectively;

first spring means overlying the facing major surfaces of the first and second plate means;

second spring means extending along the interconnection of the first and second plate means;

a first air permeable material consisting of plastic mesh overlying the first spring means applied over the first plate means and secured to the first plate means edges;

a second air permeable material consisting of an aluminum wire mesh overlying the first spring means applied over the second plate means and secured to the second plate means edges;

a first air flow barrier located over the second spring means and edge interconnected with both the first and second air permeable materials;

a second air flow barrier located on the first spring means in the central leading top edge portion of the first plate means and the first air permeable material; and means mounted onto the second air flow barrier for interconnecting a source of pressurized modified air to the seat pad plenum defined by the first and second plate means covered by the first and second air permeable materials and the first and second air flow barriers.

* * * * *